US008657436B2

(12) United States Patent
Noguchi et al.

(10) Patent No.: US 8,657,436 B2
(45) Date of Patent: Feb. 25, 2014

(54) MEDIA CONVEYANCE DEVICE, PRINTING DEVICE, AND MEDIA CONVEYANCE METHOD

(75) Inventors: Akihiko Noguchi, Nagano-ken (JP); Hiroshi Hamakawa, Nagano-ken (JP); Tetsugo Ishida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 55 days.

(21) Appl. No.: 13/541,986

(22) Filed: Jul. 5, 2012

(65) Prior Publication Data

US 2013/0016168 A1 Jan. 17, 2013

(30) Foreign Application Priority Data

Jul. 11, 2011 (JP) ..... 2011-152870
Jul. 12, 2011 (JP) ..... 2011-153711

(51) Int. Cl.
*B41J 2/01* (2006.01)

(52) U.S. Cl.
USPC ..... 347/104; 347/101; 347/16

(58) Field of Classification Search
USPC ..... 347/104, 101, 16; 242/563, 325.3
See application file for complete search history.

(56) References Cited

FOREIGN PATENT DOCUMENTS

| | | |
|---|---|---|
| JP | 05-017056 | 1/1993 |
| JP | 06-040649 | 2/1994 |
| JP | 06-144650 | 5/1994 |
| JP | 06-144664 | 5/1994 |
| JP | 2001-261206 | 9/2001 |
| JP | 2003-012205 | 1/2003 |
| JP | 2003-276264 | 9/2003 |

*Primary Examiner* — Henok Legesse

(57) ABSTRACT

A conveyance device has a roll rotating unit that rotates a roll of sheet medium forward and in reverse, and a conveyance path along which is an upstream roller and a downstream roller for conveying the medium and cooperate in a reverse and rewind operation. A control unit controls driving of the upstream roller, the downstream roller, and the roll rotating unit, such that, during the reverse and rewind operation, the control unit (i) drives the upstream roller and the roll rotating unit, (ii) stops driving the upstream roller while continuing to drive the roll rotating unit, first slack being created as a result of (i) or (ii), (iii) causes the medium to be nipped at the downstream roller, and (iv) drives the upstream roller while the medium is nipped at the downstream roller to create second slack.

12 Claims, 5 Drawing Sheets

MEDIA CONVEYANCE DEVICE, PRINTING DEVICE, AND MEDIA CONVEYANCE METHOD

RELATED APPLICATION(S)

This application claims priority under 35 U.S.C. §119 on Japanese application nos. 2011-152870 and 2011-153711, filed Jul. 11, 2011 and Jul. 12, 2011, respectively. The content of each such application is incorporated herein by reference.

BACKGROUND

1. Technical Field

The present invention relates to conveyance devices that convey sheet media stored in a roll, and relates more particularly to media conveyance devices that can perform a reversing operation in a short time, convey media accurately in reverse, improve throughput, and prevent paper jams.

2. Related Art

Receipt printers and other devices that process sheet media (such as paper) stored in a roll have a device for conveying the media to a processing position. The conveyance device usually has an upstream roller that feeds the media from the roll to the conveyance path, and a downstream roller that supplies the fed media to the processing position, and the media is conveyed by driving these rollers.

The media must be conveyed in reverse after finishing one job in order to prepare for the next job or for maintenance, for example, in printers and other devices having such a conveyance device. Reversing the media involves an operation that rotates the media stored in a roll on the roll axis and rewinds the media to a specific position. The reversing operation is also conventionally performed with the upstream roller applying pressure to the media, that is, with tension applied between the upstream roller and the media roll.

Related to this technology, Japanese Unexamined Patent Appl. Pub. JP-A-H06-144664 is directed to a method of correcting bias in roll paper supplied to a plotter. This method applies tension to the roll paper while conveying the paper over the recording surface, and then allows the fed roll paper to sag while winding it around the paper roll. Slack in the roll paper is then removed by stopping reverse rotation of the drive roller and the paper roll in the last step of winding the paper around the paper roll. These steps repeat several times to remove the bias. Stopping reverse rotation of the paper roll without delay at this time is also described.

However, if a control method that tracks a predetermined deceleration curve (a speed curve over time) is used in the conventional reversing operation described above as the method of slowing and stopping rotation of the roll media when stopping operation, unstable behavior, such as re-acceleration while slowing, can occur due to inertia changing with the roll diameter. This can then result in an increase in the time or distance needed to stop. In addition, because tension is applied to the medium between the upstream roller and the media roll, if the direction or position of the media shifts on the media roll side, that shift gets transferred to the upstream roller located downstream therefrom or to the downstream side of the upstream roller. Because this shift occurs easily particularly when the roll diameter is large and is amplified with propagation downstream, the media can become jammed in the structural members of the conveyance path when the shift is great. If operation stops when the media has shifted, media processing will also be shifted when the media is then conveyed forward for processing, and process quality will drop.

Furthermore, while stopping reverse rotation of the paper roll without delay is described in JP-A-H06-144664, a specific method is not disclosed, and what to do about movement of the paper due to roll paper inertia is not addressed. As a result, when the paper shifts from the correct position, time is required to correct the position. There is also a problem with the precision of the stopping position because there is no awareness of the stopping position in the conveyance direction and the inertia of the paper roll when driving stops is not considered.

SUMMARY

A conveyance device according to the invention conveys sheet media stored in a roll, executes a media reversing operation in a short time, improve throughput, conveys the media precisely during the reversing operation, and prevents media jams.

A first aspect of the invention is a conveyance device comprising an upstream roller configured to rotate forward to convey a medium of a sheet form stored in a roll in a conveyance direction to a conveyance path and to rotate in reverse to move the medium in a reverse direction; a downstream roller configured to rotate to convey the medium to a processing position; a roll rotating unit configured to rotate forward to convey the medium in the conveyance direction and to rotate in reverse to rewind the medium; and a control unit configured to control driving of the upstream roller, the downstream roller, and the roll rotating unit, such that, during an operation that reverses and rewinds the medium, the control unit (i) drives the upstream roller and the roll rotating unit, (ii) stops driving the upstream roller while continuing to drive the roll rotating unit, first slack being created as a result of (i) or (ii), (iii) causes the medium to be nipped at the downstream roller, and (iv) drives the upstream roller while the medium is nipped at the downstream roller to create second slack.

Because this aspect of the invention rewinds the medium with slack (first slack) between the upstream roller and the roll rotating unit in the reversing operation that rewinds the medium, if the widthwise position or direction of the medium shifts, propagation of this shift to the upstream side is inhibited. Thus, there is no danger of the medium downstream from the upstream roller shifting greatly. Forceful contact with structural parts of the conveyance path, including a paper guide, and resulting paper jams can therefore be avoided. Moreover, print quality can be improved because the medium can be supplied desirably with little shifting to the printing position.

In addition, because slack (second slack) is produced in the medium between the upstream roller and the downstream roller after reverse conveyance by the upstream roller, the distance moved between the time when the roll rotating unit should stop and when it actually stops can be absorbed by this slack, the leading end of the medium can be held at the correct position, and the medium can be precisely reversed in a short time.

In another aspect of the invention, the first slack is created between the upstream roller and the roll; and the control unit drives the upstream roller and the roll rotating unit while the first slack is present and while the downstream roller is not suppressing the medium to move a leading end of the medium to a specific position.

In another aspect of the invention, the second slack is created between the upstream roller and the downstream roller; and the control unit drives the upstream roller while the second slack is present and while the medium is nipped at the downstream roller to convey the medium a specific amount in the conveyance direction.

In another aspect of the invention, the conveyance device further comprises a follower roller disposed opposite the upstream roller with the medium in between and configured to move into a position to contact the medium; and an encoder disposed to the follower roller; wherein the control unit stops a motor of the roll rotating unit immediately when the encoder detects rotation of the follower roller.

By so stopping the roll rotating unit, the distance that the medium moves before actually stopping can be shortened, and the amount of slack previously created between the upstream roller and the downstream roller can therefore be minimized. As a result, there is no need to increase the size of the conveyance path structure to accommodate slack, the time required for the reversing operation can be minimized, and printer throughput can be improved.

In another aspect of the invention, in the rewind operation, a time at which the roll rotating unit is driven is delayed relative to a time at which the upstream roller is driven, or a speed at which the roll rotating unit is driven is slower than a speed at which the upstream roller is driven.

In another aspect of the invention, the conveyance device further preferably comprises a guide device that determines the widthwise position of the medium between the upstream roller and the downstream roller.

This aspect of the invention enables precise media conveyance because the widthwise position of the process medium can be restricted.

Another aspect of the invention entails a printing device including the conveyance device described above and a head unit that prints on the medium at the processing position.

Another aspect of the invention is embodied in a conveyance method for a conveyance device that has an upstream roller, a downstream roller, a roll rotating unit that rotates to convey a medium stored in a roll in a conveyance direction and rotates to rewind the medium, and a control unit that controls driving of the upstream roller, the downstream roller, and the roll rotating unit. The method comprises driving the upstream roller and the roll rotating unit; and stopping driving the upstream roller while continuing to drive the roll rotating unit. The driving of the upstream roller and the roll rotating unit or the stopping driving of the upstream roller while continuing to drive the roll rotating unit creates first slack. The method further comprises causing the medium to be nipped at the downstream roller; and driving the upstream roller while the medium is nipped at the downstream roller to create second slack.

In a conveyance method according to another aspect of the invention, the first slack is created between the upstream roller and the roll; and the control unit drives the upstream roller and the roll rotating unit while the first slack is present and while the downstream roller is not suppressing the medium to move a leading end of the medium to a specific position.

In a conveyance method according to another aspect of the invention, the second slack is created between the upstream roller and the downstream roller; and the control unit drives the upstream roller while the second slack is present and while the medium is nipped at the downstream roller to convey the medium a specific amount in the conveyance direction.

In a conveyance method according to another aspect of the invention, a follower roller is disposed opposite the upstream roller with the medium in between and configured to move into a position to contact the medium, an encoder is disposed to the follower roller, and the control unit stops a motor of the roll rotating unit immediately when the encoder detects rotation of the follower roller.

In a conveyance method according to another aspect of the invention, in the first driving step, a time at which the roll rotating unit is driven is delayed relative to a time at which the upstream roller is driven, or a speed at which the roll rotating unit is driven is slower than a speed at which the upstream roller is driven.

Other objects and attainments together with a fuller understanding of the invention will become apparent and appreciated by referring to the following description and claims taken in conjunction with the accompanying drawings.

DESCRIPTION OF EMBODIMENTS

Figure 1:
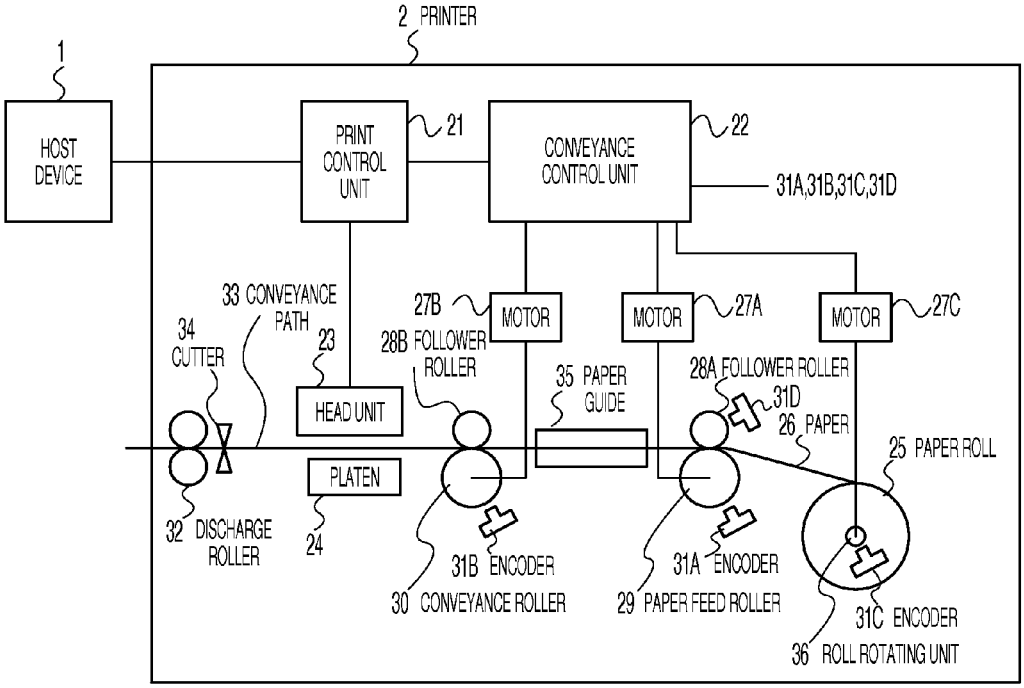
FIG. 1 is a block diagram of a preferred embodiment of a printing device having a conveyance device according to the invention.

A preferred embodiment of the present invention is described below with reference to the accompanying figures. It will be apparent to those skilled in the art in light of the following disclosure that the scope of the invention is not limited by the embodiment described below. Note also that identical or similar parts are described using the same reference numerals or symbols in the accompanying figures.

FIG. 1 is a block diagram of a preferred embodiment of a printer having a conveyance device according to a preferred embodiment of the invention. The printer 2 shown in FIG. 1 executes a printing process that conveys paper 26 stored in a roll to a printing position using a paper feed roller 29 (upstream roller) and conveyance roller 30 (downstream roller).

During reverse conveyance, or more specifically when the paper 26 (wound in paper roll 25 in this embodiment) is rewound to a specific position between jobs, for example, the conveyance of paper 26 is reversed by driving the paper feed roller 29 and roll rotating unit 36 while keeping slack in the paper 26 between the paper feed roller 29 and roll rotating unit 36 (first slack). The paper 26 is then conveyed only a specific distance by driving the paper feed roller 29 forward while holding the paper 26 stationary between the conveyance roller 30 and follower roller 28B before driving the roll rotating unit 36 stops. As a result, this slack inhibits propagating to the downstream side any shifting of the paper 26 that may have occurred on the paper roll 25 side while being rewound. In addition, because slack is also produced between the paper feed roller 29 and conveyance roller 30 (second slack) by this forward conveyance, excessive rewinding of the paper 26 resulting from the control time and inertia when the roll rotating unit 36 finishes rewinding the paper 26 can be absorbed by this slack. Accurate reverse conveyance of the paper 26 is therefore possible because the stopped position can be held reliably and shifting of the paper 26 on the downstream side can be suppressed.

When the encoder 31D disposed to the follower roller 28A of the paper feed roller 29 detects rotation, supply of power to the motor 27C of the roll rotating unit 36 stops immediately (the duty cycle goes to 0), and the roll rotating unit 36 is stopped. As a result, the roll rotating unit 36 can be stopped in a short time, forward conveyance of the paper 26 can therefore be minimized, and the amount of time that is needed can be shortened. The entire reversing operation can therefore be completed in a short time, and printer throughput can be improved.

As shown in FIG. 1, the printer 2 is a device that receives commands from a computer or other host device 1 and executes a printing process, and in this embodiment is a printing device that uses paper 26 from a paper roll 25 and prints continuously while conveying the paper 26.

FIG. 1 schematically describes the configuration of the printer 2. This printer 2 has a printing system that controls print content and executes the printing process on the paper 26, and a conveyance system that conveys the paper 26.

A print control unit 21 is disposed to the printing system. The print control unit 21 receives printing instructions from the host device 1, and sends print commands to the head unit 23 and sends conveyance requests to the conveyance control unit 22 of the conveyance system to convey the paper 26 according the received instructions. The head unit 23 prints on the paper 26 while it moves at a specific speed between the head unit 23 and platen 24 according to the print commands.

As shown in FIG. 1, the conveyance system performs an operation that continuously conveys the paper 26, which is held as a paper roll 25 in the print medium storage location, forward (downstream) through the conveyance path 33, cuts the printed portion with the cutter 34, and discharges the cut portion from the printer 2 by means of a discharge roller 32. The conveyance system also performs a reversing operation in the opposite direction (upstream) after this conveyance operation so that the leading end of the paper 26 comes to a specific position (indexing position) on the upstream side of the head unit 23.

The conveyance system includes a paper feed roller 29 (upstream roller) and conveyance roller 30 (downstream roller) that are driven by corresponding motors (27A, 27B). Disposed opposite each of these rollers with the paper 26 therebetween is a corresponding follower roller (28A, 28B). Each follower roller can move perpendicularly to the surface of the paper 26, and can be set to two vertical positions. At the down position in contact with the paper 26, the follower rollers are urged with a downward perpendicular force to the surface of the paper 26, pressing the paper 26 with a force perpendicular to the paper 26 surface and holding the paper 26 with the opposing roller (29, 30). This state is called the nipped state. At the up position separated from the paper 26, the force holding the paper 26 is not applied. This is called the released state.

A function of the paper feed roller 29 is to supply the paper 26 from the paper roll 25 to the conveyance path 33. The paper feed roller 29 is driven by torque from the motor 27A transferred thereto through a speed reducer, and moves the paper 26 by the force of friction against the paper 26 pressed between the paper feed roller 29 and follower roller 28A. These rollers are also used when reversing the paper 26.

A function of the conveyance roller 30 is to convey the paper 26 supplied by the paper feed roller 29 to the printing position, or more specifically to the head unit 23 position. The conveyance roller 30 is turned by torque transferred thereto from the motor 27B through a speed reducer, and moves the paper 26 by the force of friction against the paper 26 held between the conveyance roller 30 and follower roller 28B.

An encoder 31A, 31B is respectively disposed to the paper feed roller 29 and conveyance roller 30, and rotation of the rollers detected by the corresponding encoders is reported to the conveyance control unit 22. An encoder 31D is also disposed to the follower roller 28A of the paper feed roller 29, and rotation of the follower roller 28A is likewise detected and reported thereby to the conveyance control unit 22. This encoder 31D is used in the reversing operation.

Figure 2:
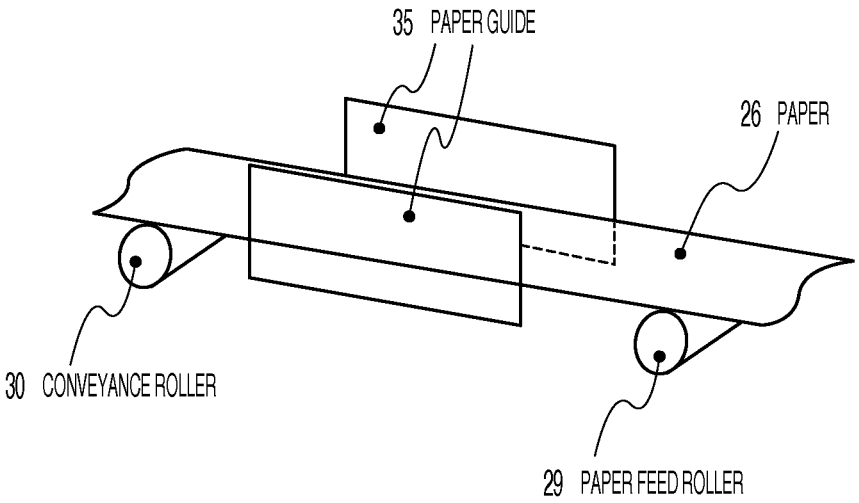
FIG. 2 is an oblique view of a paper guide constructed and arranged in accordance with embodiments of the invention.

A paper guide 35 is also disposed between the paper feed roller 29 and conveyance roller 30. FIG. 2 is an oblique view of the paper guide 35. As shown in FIG. 2, the paper guide 35 is composed of flat panels disposed on opposite sides of the paper 26 width so that the paper 26 is held therebetween with a specific gap to the paper. The widthwise position of the paper 26 is thus controlled so that the position of the paper 26 does not shift widthwise.

The conveyance system also includes the roll rotating unit 36. The roll rotating unit 36 rotates the paper 26 stored in a paper roll 25, and rewinds the paper 26 that was fed. The roll rotating unit 36 is driven by motor 27C, and includes a speed reducer (drive wheel train) that transfers torque from the motor 27C, and a shaft that passes through the center of the paper roll 25 and is rotated by the torque transferred thereto through the speed reducer.

An encoder 31C is also disposed to the roll rotating unit 36, and detects and reports rotation of the paper roll 25 to the conveyance control unit 22.

Next, the conveyance control unit 22 shown in FIG. 1 is the part that controls the conveyance system, and based on instructions from the print control unit 21 controls the above-described paper 26 conveyance operation. More specifically, the conveyance control unit 22 controls driving and stopping the paper feed roller 29, conveyance roller 30, and roll rotating unit 36 to desirably convey the paper 26 forward in the paper feed direction and in reverse. Controlling conveyance in reverse is a feature of this printer 2, and is described specifically below.

While not shown in the figures, the conveyance control unit 22 includes a CPU, ROM, RAM, and NVRAM (nonvolatile memory), and the foregoing process executed by the conveyance control unit 22 is executed by the CPU operating according to a program stored primarily in ROM.

Data required for processing is temporarily stored in RAM, which also stores output from the encoders 31 that is required for controlling driving and stopping the paper feed roller 29, conveyance roller 30, and roll rotating unit 36.

The conveyance system including the paper feed roller 29, conveyance roller 30, roll rotating unit 36 and conveyance control unit 22 is an example of a conveyance device according to the invention.

The printer 2 configured as described above is characterized by controlling conveyance of the paper 26 as described in detail below.

As described above, this printer 2 executes a printing process on the paper 26 conveyed at a specific speed, and during the printing process the conveyance system performs a forward conveyance operation. When the printing process starts, the conveyance control unit 22 controls the conveyance speed of the paper feed roller 29 and conveyance roller 30 to quickly reach the specific speed, maintains that conveyance speed until the printing process ends, and stops both rollers when the printing process ends.

An operation that returns the leading end of the paper 26 to a specific printing standby position (indexing position) is required after the paper 26 cutting process of the cutter 34 and for maintenance of the printing system (such as flushing the nozzles of the head unit 23), and the conveyance system performs a reverse conveyance operation (rewinding operation) in this case. This reverse conveyance operation is described specifically below.

Figure 3:
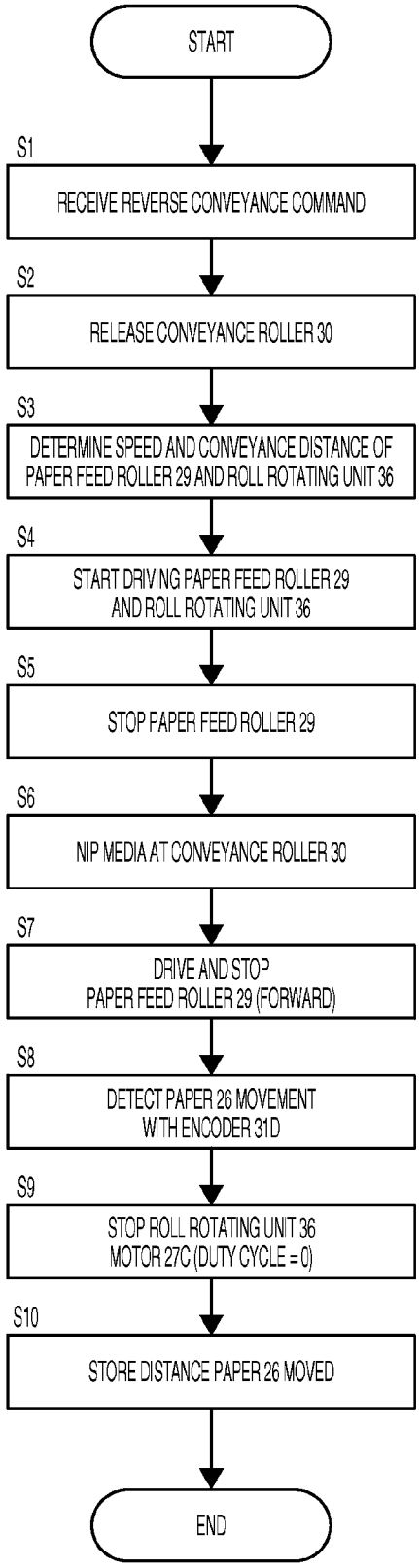
FIG. 3 is a flow chart illustrating steps in a process executed by a conveyance control unit during a reversing operation.

FIG. 3 is a flow chart showing steps in the process executed by the conveyance control unit 22 during the reverse conveyance operation. First, when a command to start reversing the paper is received from the print control unit 21 (step S1), the conveyance control unit 22 sets the follower roller 28B of the conveyance roller 30 to the up, or release, position, which is described above, to release pressure on the paper 26 at that point (step S2).

FIG. 4 describes operation in different steps of the reversing operation. FIG. 4A shows the state after releasing the paper 26 at the conveyance roller 30. This state occurs immediately after forward conveyance when there is no slack in the paper 26 on the conveyance path and the leading end of the paper 26 is downstream from the head unit 23 (printing position).

Next, the conveyance control unit 22 determines the speed of the paper feed roller 29 and roll rotating unit 36 and the conveyance distance of the paper when reversing the paper (step S3). The conveyance distance is determined based on the position of the leading end of the paper 26 before the reversing operation starts. In the operation after the paper is cut as described above, the conveyance distance is the distance from the cutter 34 to the printing standby position described above. The conveyance speed of the paper feed roller 29 is a value (Vk) that is predetermined for the reversing operation, and the conveyance speed of the roll rotating unit 36 (Vr) is determined from factors such as the diameter of the paper roll 25 at that time and is less than or equal to the conveyance speed of the paper feed roller 29. That is, $Vr \leq Vk$.

The conveyance control unit 22 then starts driving the paper feed roller 29 (step S4). Driving the roll rotating unit 36 could start simultaneously at this time, or after a specific delay. If simultaneously, the conveyance speed of the roll rotating unit 36 (Vr) must be set to a value that is significantly slower than the conveyance speed of the paper feed roller 29 (Vk). This start time is set appropriately based on the speed, and is set so that slack is produced between the paper feed roller 29 and paper roll 25 during reverse conveyance and the amount is slack is within a specific range.

After driving the paper feed roller 29 and roll rotating unit 36 starts, the conveyance control unit 22 uses PID control based on the output values of the encoders 31A, 31C to achieve the conveyance speeds described above.

Figure 4A:
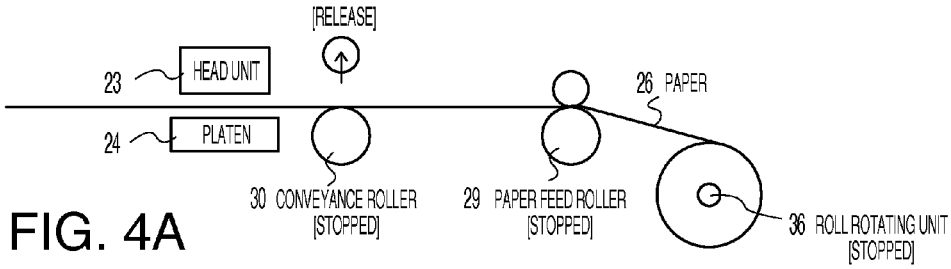
FIG. 4 shows the state of the media in different steps of the reversing operation.
Figure 4B:
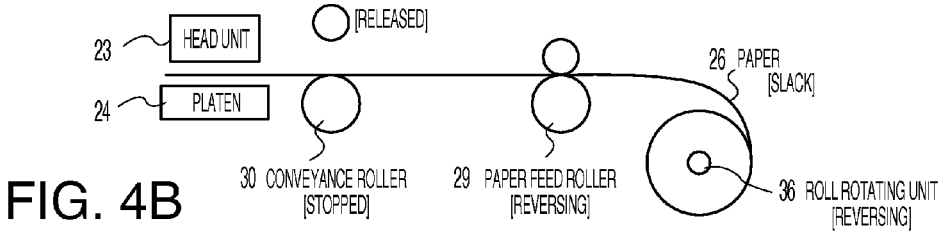

FIG. 4B shows the paper while being reversed. As described above, because there is a difference in the conveyance speed of the paper feed roller 29 and roll rotating unit 36 or the timing when driving starts, the paper is conveyed more by the paper feed roller 29 and slack is produced in the paper 26 between the paper feed roller 29 and paper roll 25 as shown in the figure. The leading end of the paper 26 also approaches the printing standby position.

As reverse conveyance then proceeds, the conveyance control unit 22 stops the paper feed roller 29 when the conveyance distance of the paper feed roller 29 reaches the amount determined above (step S5). The conveyance control unit 22 then immediately nips the paper 26 at the conveyance roller 30 (step S6). More specifically, the follower roller 28B is moved to the down, nipping, position applying pressure to the paper 26.

Figure 4C:
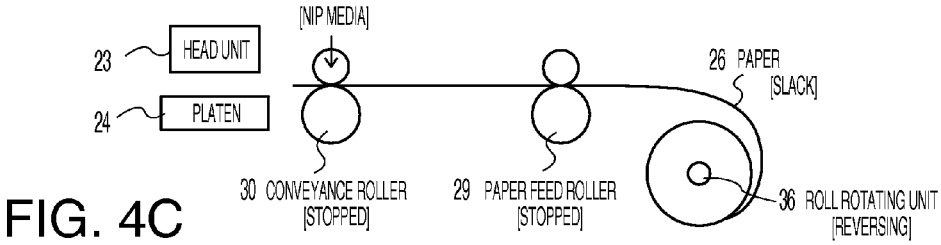

FIG. 4C shows after the paper is nipped. Because reverse conveyance by the paper feed roller 29 is completed at this time, the leading end of the paper 26 is at the printing standby position, and the paper feed roller 29 is stopped. Because conveyance (rewinding) by the roll rotating unit 36 is slower than that of the paper feed roller 29 as described above, driving the roll rotating unit 36 continues at this point, and media slack is greatest at the time the paper feed roller 29 stops.

Figure 4D:
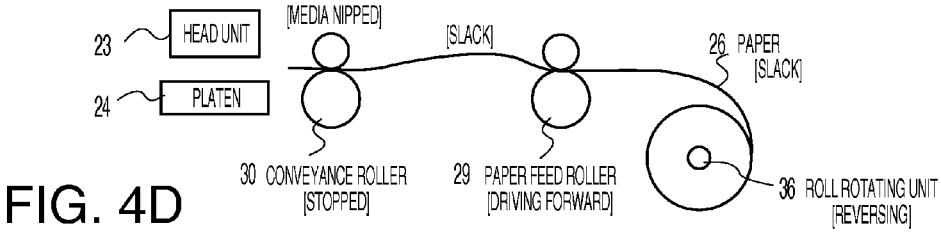

Immediately after nipping the paper is completed, the conveyance control unit 22 drives the paper feed roller 29 forward and conveys the paper 26 a predetermined distance forward (step S7). FIG. 4D shows this state. Because the paper 26 is conveyed forward from the paper feed roller 29 while the paper 26 is nipped and held stationary at the conveyance roller 30, the leading end of the paper 26 does not move and slack is produced in the paper 26 between the paper feed roller 29 and conveyance roller 30. Note that rewinding by the roll rotating unit 36 is not completed during this forward conveyance and slack between the paper feed roller 29 and paper roll 25 continues to decrease.

When conveyance a specific distance forward is completed, the conveyance control unit 22 stops the paper feed roller 29.

The conveyance control unit 22 then monitors detection of rotation by the encoder 31D disposed to the follower roller 28A of the paper feed roller 29. Because driving the paper feed roller 29 and conveyance roller 30 has stopped and movement of the paper 26 at the paper feed roller 29 has stopped when step S7 is completed, detection of rotation by the encoder 31D at this time means that the paper 26 was pulled by driving the roll rotating unit 36 to rewind and moved to the upstream side. More specifically, this means that there is no slack between the paper feed roller 29 and paper roll 25.

If the conveyance control unit 22 confirms this movement of the paper 26 (step S8), rewinding by the roll rotating unit 36 has been completed, and driving the roll rotating unit 36 stops immediately (step S9). More specifically, the duty cycle (duty factor, current supply) of the motor 27C immediately goes to zero. Even more specifically, the duty cycle is set to zero 1 encoder pulse (EP) after rotation is detected by the encoder 31D. Note that in order for rotation detection by the encoder 31D to reliably detect when the paper 26 was pulled from the paper roll 25 side and moved, rotation is preferably detected by detecting rotation a specific plural number of times.

Figure 5:
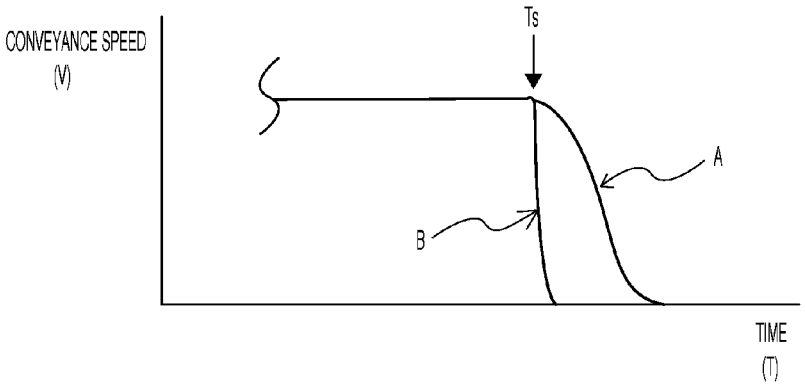
FIG. 5 graphically illustrates stopping the driving of a roll rotating unit.

FIG. 5 describes stopping driving the roll rotating unit 36. FIG. 5 is a graph showing the conveyance speed (V) of the roll rotating unit 36 over time (T) with rotation detected by the encoder 31D at time Ts. Curve A is the speed curve during conventional operation with PID control applied to achieve the speeds indicated by the curve and the speed ultimately going to zero.

Curve B shows when the duty cycle of the motor 27C goes immediately to zero, and clearly shows that rotation of the roll rotating unit 36 can be stopped in a shorter time and shorter distance. The actual speed also fluctuates up and down from curve A due to environmental factors such as the inertia of the paper roll 25 with the conventional control method, and requires more time and a longer conveyance distance.

Figure 4E:
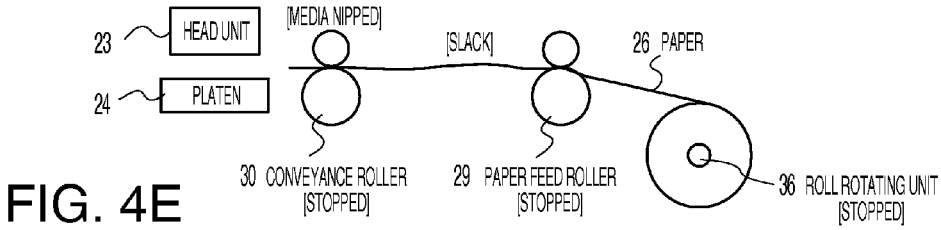

FIG. 4E shows when the roll rotating unit 36 stops, that is, when the reverse conveyance operation ends. Because rewinding by the roll rotating unit 36 is completed at this time as described above, there is no slack between the paper feed roller 29 and paper roll 25, and conveyance forward is possible. As described above, the paper 26 also continues moving to the upstream side due to the inertia of the paper roll 25 and the control time until the roll rotating unit 36 actually stops after this slack is eliminated, but this movement is absorbed by the slack created between the paper feed roller 29 and conveyance roller 30. This amount of slack therefore decreases. However, because the slack is produced so that some slack will remain, the leading end of the paper 26 is not pulled and remains positioned at the printing standby position.

The reversing operation started by the received command thus ends, and the conveyance control unit 22 stores the reverse conveyance distance of the paper 26 after the completion of step S7 in RAM or NVRAM (step S10). More specifically, how much the slack created in step S7 between the paper feed roller 29 and conveyance roller 30 decreased, or in other words how much slack there is between the paper feed roller 29 and conveyance roller 30, is stored. This value is used in the next forward paper feed process. For example, if there is not enough slack between the paper feed roller 29 and conveyance roller 30 for the next paper feed operation, the start times of the paper feed roller 29 and conveyance roller 30 are adjusted to compensate for the deficiency.

The reverse conveyance control sequence thus ends.

Because the conveyance system of the printer 2 according to this embodiment of the invention described above rewinds the paper 26 with slack created between the paper feed roller 29 and paper roll 25 in the reversing operation that rewinds the paper 26 to the paper roll 25 side, if the widthwise position or direction of the paper 26 shifts on the paper roll 25 side, propagation of this shift to the upstream side is inhibited and there is no danger of the paper 26 shifting greatly on the downstream side of the paper feed roller 29. Forceful contact with structural parts of the conveyance path 33, including the paper guide 35, leading to paper jams can therefore be avoided, and print quality can be improved because the paper 26 can be supplied desirably with little shifting to the printing position.

In addition, because slack is produced in the paper 26 between the paper feed roller 29 and conveyance roller 30 after reverse conveyance by the paper feed roller 29, the distance moved after the timing when the roll rotating unit 36 should stop, and when it actually stops can be absorbed by this slack, the leading end of the paper 26 can be held at the correct position, and the paper 26 can be precisely reversed in a short time.

Furthermore, because the roll rotating unit 36 can be stopped immediately, as described above, the distance moved by the time the roll rotating unit 36 actually stops can be shortened, and the amount of slack produced between the paper feed roller 29 and conveyance roller 30 can therefore be minimized. As a result, there is no need to increase the size of the conveyance path 33 structure to accommodate slack, the time required for the reversing operation can be minimized, and printer 2 throughput can be improved.

Precise conveyance is also possible because the widthwise position of the paper 26 can be determined by the paper guide 35.

The timing for stopping the roll rotating unit 36 can also be detected using a relatively simple encoder configuration.

The foregoing embodiment is described using paper as the print medium, but the invention is not so limited and any type of sheet media can be used.

The foregoing embodiment is also described with the conveyance device disposed to a printer, but conveyance devices applying the invention can be used with other devices that applying other processes to sheet media, including mechanical processes, laser processes, and fluid ejection processes.

The invention having been thus described, it will be apparent to those skilled in the art based on such description that the invention can be varied in many ways. Such variations are intended to be part of the invention to the extent encompassed by any of the following claims.

What is claimed is:

1. A conveyance device comprising:

an upstream roller configured to rotate forward to convey a medium of a sheet form stored in a roll in a conveyance direction to a conveyance path and to rotate in reverse to move the medium in a reverse direction;

a downstream roller configured to rotate to convey the medium to a processing position;

a roll rotating unit configured to rotate forward to convey the medium in the conveyance direction and to rotate in reverse to rewind the medium; and a control unit configured to control driving of the upstream roller, the downstream roller, and the roll rotating unit, such that, during an operation that reverses and rewinds the medium, the control unit (i) drives the upstream roller and the roll rotating unit, (ii) stops driving the upstream roller while continuing to drive the roll rotating unit, first slack being created as a result of (i) or (ii), (iii) causes the medium to be nipped at the downstream roller, and (iv) drives the upstream roller while the medium is nipped at the downstream roller to create second slack.

2. The conveyance device described in claim 1, wherein:

the first slack is created between the upstream roller and the roll; and the control unit drives the upstream roller and the roll rotating unit while the first slack in present and while the downstream roller is not suppressing the medium to move a leading end of the medium to a specific position.

3. The conveyance device described in claim 1, wherein:

the second slack is created between the upstream roller and the downstream roller; and the control unit drives the upstream roller while the second slack is present and while the medium is nipped at the downstream roller to convey the medium a specific amount in the conveyance direction.

4. The conveyance device described in claim 1, further comprising:

a follower roller disposed opposite the upstream roller with the medium in between and configured to move into a position to contact the medium; and an encoder disposed to the follower roller;

wherein the control unit stops a motor of the roll rotating unit immediately when the encoder detects rotation of the follower roller.

5. The conveyance device described in claim 1, wherein, in the rewind operation, a time at which the roll rotating unit is driven is delayed relative to a time at which the upstream roller is driven, or a speed at which the roll rotating unit is driven is slower than a speed at which the upstream roller is driven.

6. The conveyance device described in claim 1, further comprising:

a guide device that determines the widthwise position of the medium between the upstream roller and the downstream roller.

7. A printing device comprising:

the conveyance device described in claim 1; and a head unit that prints on the medium at the processing position.

8. A conveyance method for a conveyance device that has an upstream roller, a downstream roller, a roll rotating unit that rotates to convey a medium stored in a roll in a conveyance direction and rotates to rewind the medium, and a control unit that controls driving of the upstream roller, the downstream roller, and the roll rotating unit, the method comprising:

driving the upstream roller and the roll rotating unit;

stopping driving the upstream roller while continuing to drive the roll rotating unit;

wherein the driving of the upstream roller and the roll rotating unit or the stopping driving of the upstream roller while continuing to drive the roll rotating unit creates first slack;

causing the medium to be nipped at the downstream roller; and driving the upstream roller while the medium is nipped at the downstream roller to create second slack.

9. The conveyance method described in claim 8, wherein:

the first slack is created between the upstream roller and the roll; and the control unit drives the upstream roller and the roll rotating unit while the first slack is present and while the downstream roller is not suppressing the medium to move a leading end of the medium to a specific position.

10. The conveyance method described in claim 8, wherein:

the second slack is created between the upstream roller and the downstream roller; and the control unit drives the upstream roller while the second slack is present and while the medium is nipped at the downstream roller to convey the medium a specific amount in the conveyance direction.

11. The conveyance method described in claim 8, wherein:

a follower roller is disposed opposite the upstream roller with the medium in between and configured to move into a position to contact the medium;

an encoder is disposed to the follower roller; and the control unit stops a motor of the roll rotating unit immediately when the encoder detects rotation of the follower roller.

12. The conveyance method described in claim 8, wherein, in the first driving step:

a time at which the roll rotating unit is driven is delayed relative to a time at which the upstream roller is driven, or a speed at which the roll rotating unit is driven is slower than a speed at which the upstream roller is driven.

* * * * *